United States Patent [19]

Sellers

[11] Patent Number: 4,774,930

[45] Date of Patent: Oct. 4, 1988

[54] ANTI-SCUFF BOOTS FOR TILE CUTTING EQUIPMENT

[76] Inventor: Paul R. Sellers, 14807 N. 34th St., Phoenix, Ariz. 85032

[21] Appl. No.: 131,569

[22] Filed: Dec. 11, 1987

[51] Int. Cl.[4] ..... B28D 1/32

[52] U.S. Cl. ..... 125/23 T; 125/40; 225/96.5

[58] Field of Search ..... 225/96.5, 2; 125/23 T, 125/40, 23 R

[56] References Cited

U.S. PATENT DOCUMENTS 4,026,262 5/1977 Yasuga ..... 125/23 T 4,192,282 3/1980 Fischer ..... 125/23 T

*Primary Examiner*—Frank T. Yost

*Attorney, Agent, or Firm*—Herbert E. Haynes, Jr.

[57] ABSTRACT

A set of anti-scuff boots for a tile cutter comprises a pair of loops made from a soft, durable material such as leather for demountably mounting on the breaking wings of the tile cutter. The loops are connected to one another and prevented from sliding off the breaking wings by means of a strap or cord which extends over the handle of the device, preferably resting against a thumb screw in the handle which prevents the cord from slipping.

10 Claims, 1 Drawing Sheet

ANTI-SCUFF BOOTS FOR TILE CUTTING EQUIPMENT

BACKGROUND OF THE INVENTION

1. Field of the Invention

The invention relates in general to tile cutting equipment and, more particularly, to a set of boots for demountably mounting on the breaking wings of a conventional tile cutter in order to prevent scuffing, smudging, or scraping of the tile.

2. Description of the Prior Art

As is generally well known in the art, a conventional tile cutter comprises a substantially flat cutting board on which two removable inserts or cushions formed of foam rubber or other soft, springy material are mounted on laterally opposed sides of an upstanding rib. A metallic cutting handle, the upper portion of which is formed as an elongated grip and the lower portion of which is formed as a cutting head, is mounted for sliding and pivoting movement on a stationary carrying bar which is supported in spaced relationship above the cutting board. The front portion of the cutting head carries a glass cutting wheel which is used to score the tile in a desired location, and the rear portion of the cutting head comprises a pair of breaking wings which extend laterally outwardly from opposite sides of the cutting head. To use the device, the operator places a tile on top of the cushions on the cutting board, and pivots the cutting handle so that the glass cutting wheel contacts the tile. He then pulls the handle slowly but firmly across the tile, creating a score line. Then, by pivoting the handle in the opposite direction so that the breaking wings bear down on, or strike the tile, he causes the tile to break cleanly along the score line.

One problem that occurs with tile cutters of this type, however, is that the metallic breaking wings tend to leave visible scuff marks or smudges on the surface of the tile. Such marks are extremely difficult to remove except by means of a special cleaning fluid which is commerically available but which is rather expensive to purchase and time-consuming to apply. Thus, some operators have tried to eliminate the problem by wrapping several layers of tape around the breaking wings. The tap serves to "soften" the impact of the wings against the tile, and prevent them from coming into direct contact with the tile thus leaving the tile surface unmarked. This arrangement is not entirely satisfactory, however, since the tape wears out rather rapidly and most be periodically replaced. The worn tape can be peeled off and replaced with new tape, of course, but this is a rather sloppy and tedious procedure.

Accordingly, there exists a need for a new and useful set of anti-scuff boots for tile cutting equipment which overcomes some of the shortcomings of the prior art.

SUMMARY OF THE INVENTION

In accordance with the present invention, a new and useful set of anti-scuff boots are provided for demountably mounting on the breaking wings of a conventional tile cutter.

The anti-scuff boots comprise a pair of strips of a soft, yet durable material such as leather, each of which has had its opposite ends secured together to form a loop for surrounding a different one of the breaking wings. The loops are connected to one another and prevented from sliding off the breaking wings by means of a strap or cord which extends over the handle of the tile cutter.

The cord preferably rests aginst a thumb screw in the handle so that slippage of the cord is not possible. This simple mounting arrangement allows the boots to be easily replaced after repeated use has worn them out.

Accordingly, it is an object of this invention to provide a new and useful set of anti-scuff boots for demountably mounting on the breaking wings of a conventional tile cutter.

Another object of the invention is to provide a simple and inexpensive means for preventing a tile cutter from leaving scuff marks on tile.

Still another object of the invention is to provide a set of anti-scuff boots made of a material which is soft, yet durable enough to withstand repeated impact, and convenient to replace when finally worn.

The foregoing and other objects of the present invention, as well as the invention itself, may be more fully understood from the following description when read in conjunction with the accompanying drawings.

DESCRIPTION OF THE PREFERRED EMBODIMENT

Figure 1:
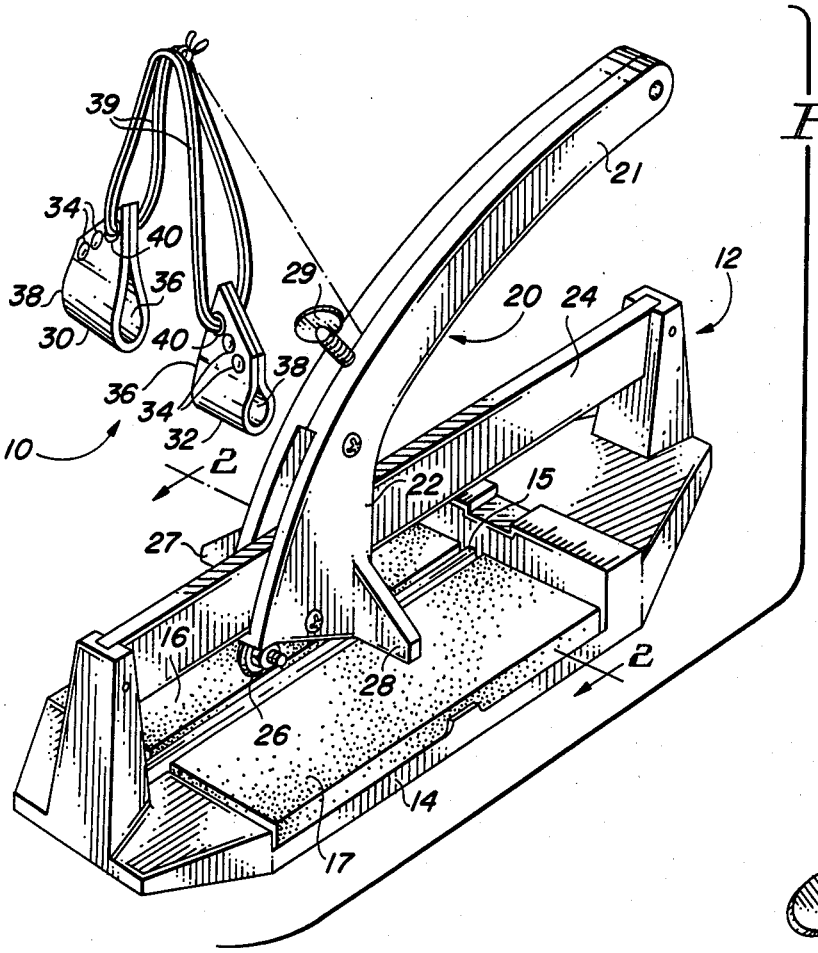
FIG. 1 is a perspective view showing the anti-scuff boots of the present invention in exploded relation to a conventional tile cutter.
Figure 4:
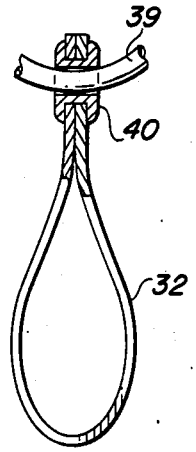
FIG. 4 is an enlarged side view, partially broken away, of one of the anti-scuff boots of the present invention.
Figure 3:
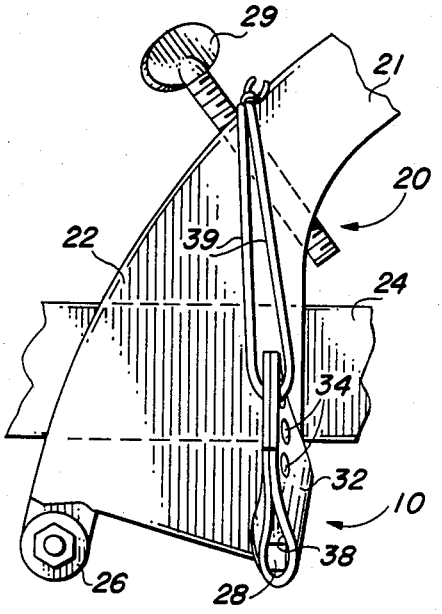
FIG. 3 is an enlarged fragmentary side view showing one of the boots mounted on a breaker wing.

Referring more particularly to the drawings, FIG. 1 shows the anti-scuff boots of the present invention, indicated generally by the numeral 10, in exploded relation to a conventional tile cutter 12.

Figure 2:
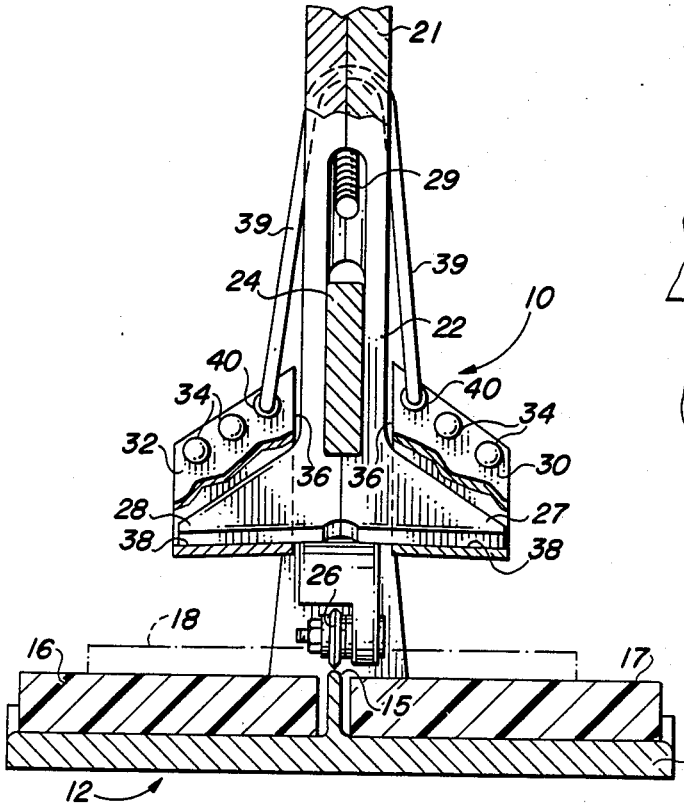
FIG. 2 is a sectional view taken through line 2—2 of FIG. 1, with the anti-scuff boots being positioned over the breaking wings of the tile cutter, and with portions broken away for the sake of clarity.

The specific details of the tile cutter 12 will of course vary from model to model, but in general, the device comprises a substantially flat cutting board 14 having an elongated upstanding breaker rib 15 with two removable inserts or cushions 16, 17 are mounted on opposite sides of the rib 15 for supporting a ceramic tile as shown in phantom lines at 18 in FIG. 2. A metallic cutting handle 20, the upper portion of which is formed as an elongated grip 21 and the lower portion of which is formed as a cutting head 22, is mounted for sliding and pivoting movement on a stationary carrying bar 24 which is supported in spaced relationship above the cutting board 14. The front portion of the cutting head 22 rotatably carries a glass cutting wheel 26 which is used to score the tile 18 in a desired location, and the rear portion of the cutting head 22 comprises a pair of generally triangular breaker wings 27, 28 which extend laterally outwardly from opposite sides of the cuttig head 22. An adjustable thumb screw 29 is provided in the handle 20 for stopping the handle is pivotable movement after the tile 18 has been cut as will hereinafter be described.

As is well known in the art, tile cutters of the type described above are used by placing a tile 18 to be cut, on the cushions 16 and 17 as shown in FIG. 2. The user then pivotably moves the cutting handle 20 so as to bring the glass cutting wheel 26 into engagement with the extreme edge of the tile 18. Then by pulling the handle slowly and firmly, with a slight pressure, across the tile, the tile will be scored along the desired break line. After being scored in this manner, the user pivots the cutting handle 20 to bring the breaking wing into engagement with the tile 18. Then by pressing down on the grip 21 the tile will be broken along the scored line.

The above mentioned anti-scuff boots 10 are used to prevent marking of the cut tile 18 which occurs whenever the breaking wings 27 and 28 push down to break the tile.

The anti-scuff boots 10 comprise a pair of loops 30, 32 for surrounding the breaking wings 27, 28 of the tile cutter 12 in order to prevent scuffing, scraping, scratching and the like. Preferably, the loops 30, 32 are formed from originally trapezoidal strips of soft, durable material, the opposite ends of which are secured together by means of rivets 34 or by other fastening means such as stitching (not shown). The trapezoidal shape of the strips ensures that when the opposite ends are secured together, the resulting loops 30, 32 will conform to the triangular shape of the wings 27, 28. Thus, each loop 30, 32 will have a relatively large opening 36 at one end for fitting over the base portion of one of the triangular wings, and a smaller opening 38 at the opposite end for fitting over the apex portion of the wing with the fit being snug enough to prevent the loops 30, 32 from easily sliding of the wings 27, 28 but loose enough to allow easy removal and replacement. The width of each of the loops 30, 32 is approximately equal to the length of each of the triangular breaking wings 27, 28 from base to apex, so that the entire bottom portion of each wing 30, 32 is covered by the loop material. Thus, the wings 27, 28 are prevented from directly contacting the surface of the tile, and from leaving any scuff marks thereon.

One material which has been found to be extremely well suited for the construction of the loops 30, 32 is leather. However, other materials of comparable cost, durability and softness may also be used. The thickness of the chosen material is also an important consideration, since the durability of the material tends to increase with its thickness. At the same time, however, the material must be thin enough so that a tile of at least average thickness can be accommodated between the breaking wings 27, 28 and the removable cushions 16, 17 on the cutting board 14.

The loops 30, 32 are connected to one another and prevented from sliding off the breaking wings 27, 28 by means of a strap or cord 39 which is threaded through a grommet 40 in the top riveted edge of each of the loops 30, 32 and which extends over the handle 20 of the tile cutter 12. The cord 39 preferably rests against the adjustable thumb screw 29 in the handle 20 so that slippage of the cord 39 relative to the handle 20 is prevented. This simple mounting arrangement allows the boots 10 to be easily replaced after repeated use has worn them out.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. A set of anti-scuff boots for use with a tile cutter of the type including a movable handle having a pair of breaking wings formed at one end thereof, said anti-scuff boots comprising:

(a) a pair of loops for surrounding the breaking wings of the tile cutter, each loop being constructed from a strip of soft, durable material for covering the bottom of the breaking wings and preventing the breaking wings from leaving scuff marks on a tile; and (b) attachment means for demountably securing said loops to the handle of the tile cutter and preventing said loops from sliding off the breaking wings.

2. The anti-scuff boots of claim 1, in which said attachment means comprises a cord for extending over the handle of the tile cutter and connecting said loops to one another.

3. The anti-scuff boots of claim 1, in which said loops are made from leather.

4. In a tile cutter of the type including a generally flat cutting board provided with removable cushions for supporting a ceramic tile, a stationary carrying bar supported in spaced relationship above the cutting board, a handle mounted for sliding and pivoting movement on the carrying bar, a cutting head formed on the lower portion of said handle, a cutting wheel carried in the front portion of said cutting head, and a pair of generally triangular breaking wings of predetermined length extending from opposite sides of the rear portion of said cutting head, the improvement comprising:

(a) a pair of loops demountably carried on said breaking wings in surrounding relationship therewith, each of said loops being constructed from a soft, durable material for covering the bottom of said breaking wings and preventing said breaking wings from leaving scuff marks on a tile impacted by said breaking wings;

(b) attachment means for demountably securing said loops to the handle of said tile cutter and preventing said loops from sliding off said breaking wings.

5. The anti-scuff boots of claim 4, in which said attachment means comprises a cord which extends over said handle of said tile cutter and connects said loops to one another.

6. The anti-scuff boots of claim 5, in which each of said loops comprises:

(a) a trapezoidal strip of material which has been folded to substantially conform to the triangular shape of said breaking wings; and (b) fastening means for fastening opposite ends of said strip together; and (c) a grommet for receiving said cord to attach said loops together.

7. The anti-scuff boots of claim 4, in which said loops are made from leather.

8. A tile cutter comprising:

(a) a generally flat cutting board provided with soft, removable cushions for supporting a ceramic tile;

(b) a stationary carrying bar supported in spaced relationship above said cutting board;

(c) a handle mounted for sliding and pivoting movement on said carrying bar, with the upper portion of said handle being formed as an elongated grip and the lower portion of said handle being formed as a cutting head;

(d) a cutting wheel carried in the front portion of said cutting head for scoring a tile supported on said cutting board;

(e) a pair of generally triangular breaking wings of predetermined length extending from opposite sides of the rear portion of said cutting head for breaking said tile along a score line produced by said cutting wheel;

(f) an adjustable thumb screw mounted in said handle for stopping movement of said handle when said tile has been broken; and (g) a set of anti-scuff boots demountably carried on said breaking wings for preventing said breaking wings from leaving scuff marks on said tile when said breaking wings strike said tile, said anti-scuff boots including, (i) a pair of loops demountably carried on said breaking wings in surrounding relationship therewith, each of said loops being constructed from a strip of soft, durable material approximately equal in width to the predetermined length of each of said breaking wings so as to entirely cover the bottom surface thereof, and defining a large opening for fitting over the base portion of one of said wings and a smaller opening for fitting over the apex of said wing and (ii) attachment means for demountably securing said loops to the handle of said tile cutter and preventing said loops from sliding off said breaking wings.

9. The anti-scuff boots of claim 8, in which said attachment means comprises a cord which connects said loops together, said cord extending over said handle and being held in a stationary position by resting against said adjustable thumb screw in said handle.

10. The anti-scuff boots of claim 8, in which said loops are made from leather

* * * * *